US006820789B2

(12) United States Patent
Lipsky et al.

(10) Patent No.: US 6,820,789 B2
(45) Date of Patent: Nov. 23, 2004

(54) MAGAZINE WITH BOLT-SHAPED FASTENING ELEMENTS FOR A SETTING TOOL

(75) Inventors: Robert Lipsky, Hochst (AT); Norbert Wohlwend, Nendeln (LI); Robert Jakob, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 10/229,722

(22) Filed: Aug. 27, 2002

(65) Prior Publication Data

US 2003/0041696 A1 Mar. 6, 2003

(30) Foreign Application Priority Data

Aug. 30, 2001 (DE) ..... 101 42 561

(51) Int. Cl.[7] ..... B27F 7/07
(52) U.S. Cl. ..... 227/120; 227/10; 227/8
(58) Field of Search ..... 227/120, 8, 10, 227/113

(56) References Cited

U.S. PATENT DOCUMENTS 3,734,377 A * 5/1973 Munn ..... 227/120
3,929,269 A * 12/1975 Hodil ..... 227/10
5,484,094 A * 1/1996 Gupta ..... 227/8
6,145,723 A * 11/2000 Gupta ..... 227/8

* cited by examiner

*Primary Examiner*—Eugene Kim
*Assistant Examiner*—Michelle Lopez
(74) *Attorney, Agent, or Firm*—Sidley Austin Brown & Wood, LLP

(57) ABSTRACT

A magazine with bolt-shaped fastening elements for a setting tool and extending sidewise of a bolt guide of the setting tool and including an attachment region (2) provided at an end region of the magazine (1) facing in the setting direction; and a washer holder (6) releasably attachable to the attachment region (2) and having a central axis that extends substantially coaxially with a central axis of a receiving bore of the bolt guide (3).

7 Claims, 2 Drawing Sheets

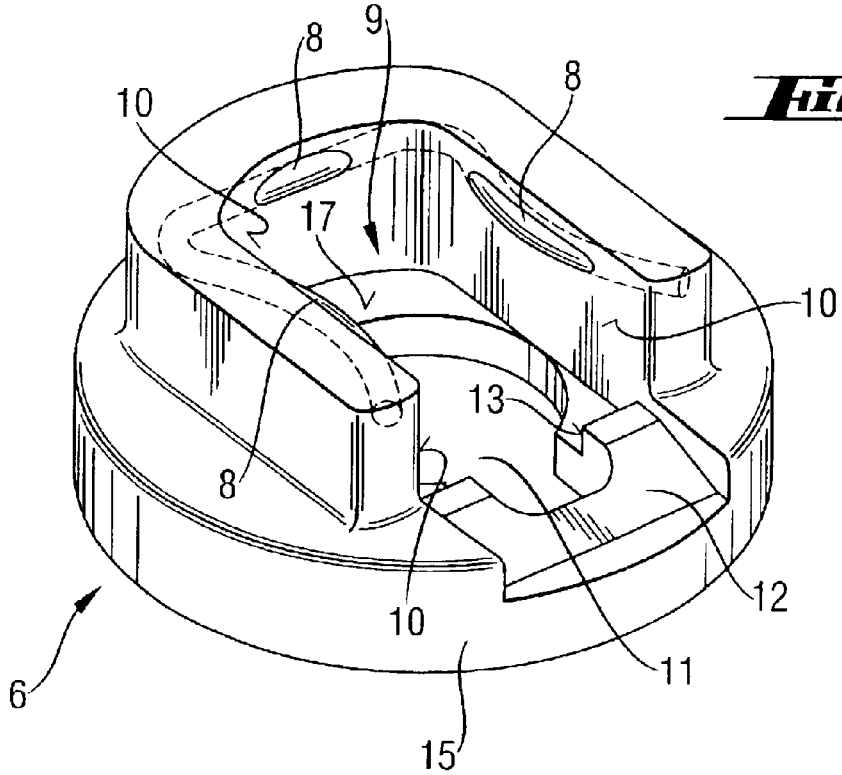
Fig. 3
Fig. 4
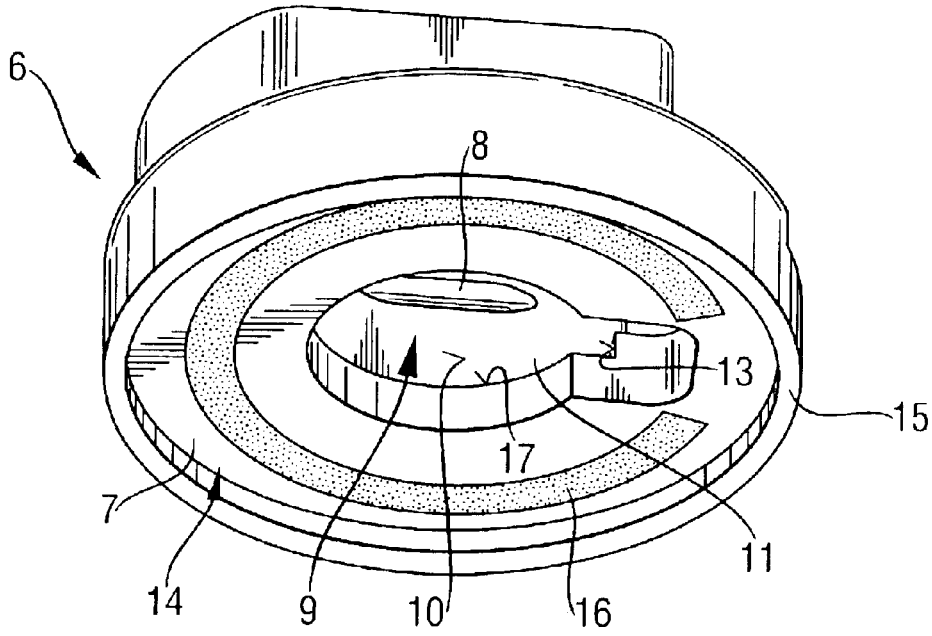

MAGAZINE WITH BOLT-SHAPED FASTENING ELEMENTS FOR A SETTING TOOL

BACKGROUND OF THE INVENTION

1. Field of the Invention

The present invention relates to a setting tool and, in particular, to a magazine for a setting tool and extending sidewise of a bolt guide of the setting tool which is displaceable in the setting tool housing parallel to a setting direction of a fastening element.

2. Description of the Prior Art

European Publication discloses an explosive powder charge-operated setting tool having a housing, a runner longitudinally displaceable in the housing, and a bolt guide adjoining the runner at its setting direction side. The bolt guide advances, before each setting process, automatically a single bolt-shaped fastening element from a magazine located sidewise of the bolt guide and containing a plurality of bolt-shaped fastening elements.

Up to the present, washer holders were used only with separate bed plates. In most cases, the washer holder is integrated in the bolt guide. It is formed, as a rule, of steel. The washers were retained with a magnet or mechanically, with a clamp ring or the like.

During the setting process, the forces applied by a head of a set fastening element to the surface of an attachable object should be distributed over a large surface area of the object surface. Therefore, it would have been very advantageous if a to-be-set fastening element could be provided, with very little costs, with a washer.

Accordingly, an object of the present invention is to provide a magazine for a setting tool which would insure that each fastening element is set together with a washer.

SUMMARY OF THE INVENTION

This and other objects of the present invention, which will become apparent hereinafter, are achieved by providing a magazine having an attachment region provided at an end region of the magazine facing in the setting direction, and a washer holder releasably attachable to the attachment region and having a central axis that extends substantially coaxially with a central axis of a receiving bore of the bolt guide. The advantage of providing an attachment region in a magazine consists in that the washer holder can be attached to the magazine or be removed therefrom as needed. The washer holder receives a single washer at a time and reliably holds it until the setting tool is pressed against a surface of a constructional component. The washer is so held in the washer holder that the washer bore is coaxial with the longitudinal axis of a fastening element located in the bolt guide.

In order to achieve a reliable and backlash free connection between the attachment region of the magazine and the washer holder, preferably, the washer holder has a connection region connectable with the attachment region. The connection region of the washer holder can, e.g., be formlockingly connected with the attachment region of the magazine. Advantageously the means for formlockingly connecting the connection region with the attachment region of the magazine includes a projection provided in the connection region of the washer holder and cooperating with an opening formed in an outer profile of the attachment region of the magazine. Advantageously the opening is formed as a groove extending transverse to the setting direction. The projection extends beyond an inner profile of the connection region and is formed by a spring preloaded in a direction transverse to the setting direction and formed, e.g., as a U-shaped spring stirrup.

In order to prevent rotation of the washer holder relative to the attachment region, advantageously, the outer profile of the attachment region which extends transverse to the setting direction, and an inner profile of the connection region deviate from a circular shape.

For a reliable retention of a washer in the washer holder. the washer holder has a receiving region provided at its setting direction side and having a stop surface facing in the setting direction. A circumferential annular web surrounds the stop surface and projects therepast in the setting direction. The annular web is formed resiliently expandable at least in a radial direction. When a washer is inserted in the receiving region, the annular web elastically expands radially so that the washer is retained in the receiving region with a preload.

For manufacturing reasons, advantageously the receiving region of the washer holder is formed of an elastic material. Naturally, the entire washer holder can be formed of an elastic material, e.g., of rubber. The spring, which has the shape of a U-shaped stirrup that forms the groove-engaging projection, is, in the case the wash holder is formed of rubber, vulcanized therein.

In addition or instead of the annular web, the receiving region of the washer holder can be provided with magnetic retaining means for axially retaining the washer in the washer holder. As the magnetic retaining means, a magnetic ring can be used which can be so embedded or vulcanized in the stop surface that it would not project beyond its end surface facing in the setting direction.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

BRIEF DESCRIPTION OF THE DRAWINGS

The drawings show:

FIG. 3 a perspective plan view of the washer holder shown in FIG. 2; and FIG. 4 a perspective bottom view of the washer holder shown in FIGS. 2–3.

DETAILED DESCRIPTION OF THE PREFERRED EMBODIMENT

Figure 1:
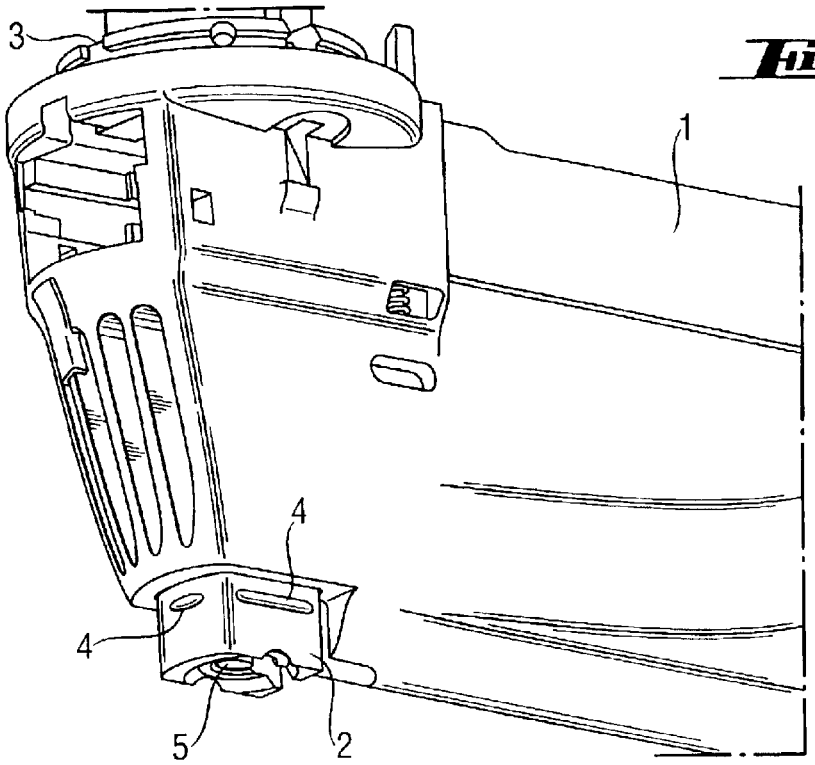
FIG. 1 a perspective view of a magazine according to the present invention and a setting direction side, end region of a drive piston of a setting tool.

FIG. 1 of the drawings shows a magazine 1 according to the present invention for use in a setting tool and in which a plurality of bolt-shaped fastening elements (not shown) is receipted. The magazine 1 projects sidewise with respect to a longitudinal extent of a bolt guide 3 which is shown only partially and is displaceable in the setting tool housing (not shown) parallel to a setting direction of the tool. In a press-on condition of the setting tool, i.e., when the setting tool is pressed against a constructional component or the like into which a bolt-shaped fastening element is to be driven-in, the bolt guide 3 extends through the magazine 1.

The magazine 1 has, in its setting direction, end region, an attachment region 2 having a rectangular or square profile. At least three sides of the outer profile of the attachment region 2 are provided each with a groove 4 that extends along a portion of a respective side in a plane extending transverse to the setting direction. The attachment region 2 extends through an end region of the drive piston 5 of the setting tool facing in the setting direction.

Figure 2:
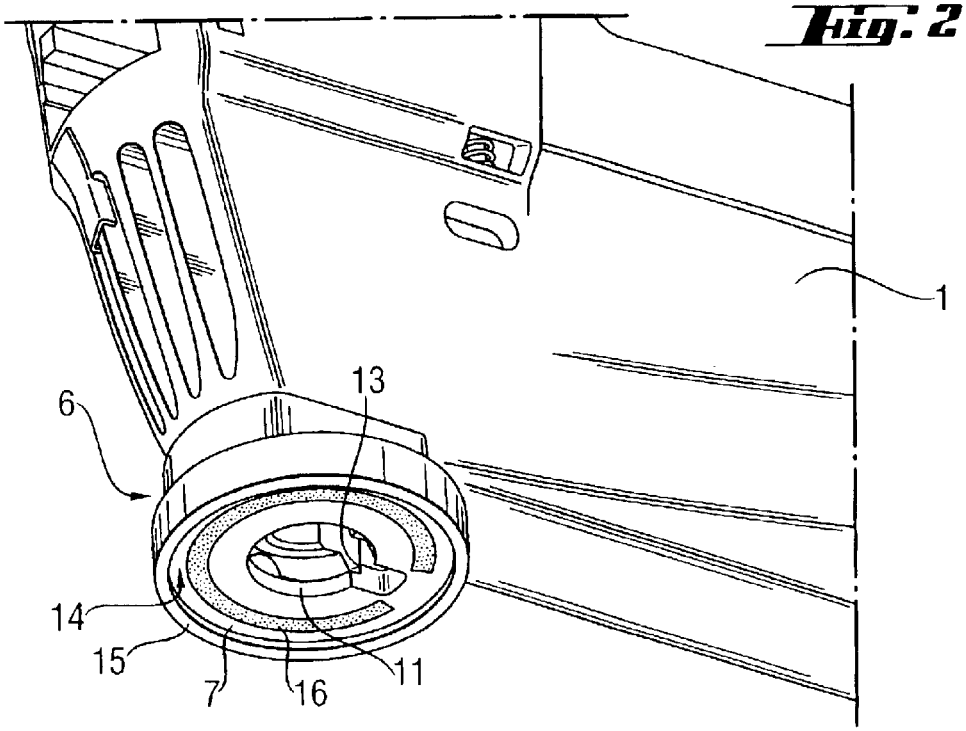
FIG. 2 a perspective view of the magazine shown in FIG. 1 with a washer holder but without the drive piston.

As shown in FIG. 2, a washer holder 6 is releasably secured to the attachment region 2. The washer holder 6 has a connection region 9 formlockingly engageable with the attachment region 2 and which would be described in more detail further below with reference to FIG. 3. Opposite the connection region 9, the washer holder 6 has a receiving region 14. The receiving region 14 is formed by a facing in the setting direction, stop surface 7 and a facing in the setting direction, annular web 15 that surrounds the stop surface 7 and projects past the stop surface in the setting direction. The annular web 15 is formed resilient in a radial direction, at least outwardly. The length of the annular web 15, measured in the setting direction, corresponds substantially to a thickness of a washer (not shown) receivable in the receiving region 14 of the washer holder 6. The annular web 15 is designed for an axial retention of the washer in the receiving region 14. The annular web 15 expands in the radial direction upon insertion of the washer and encompasses the circumference of the washer with a preload when the washer has been inserted into the receiving region 14. In addition, the washer can be secured in the receiving region 14 against falling out with magnetic retaining means 16. As shown in FIG. 4, the magnetic retaining means 16 can be formed as magnetic ring-embedded in the stop surface 7.

The entire washer holder 6 can be formed, e.g., of an elastic material such as rubber. It is, of course, possible to form only the receiving region of an elastic material. The washer holder 6 is so secured to the attachment region 2 of the magazine 1 that its central axis is essentially coaxial with the central axis of a receiving bore (not shown) of the bolt guide 3 through which a bolt-shaped fastening element is displaced.

For a formlocking connection of the connection region 9 of the washer holder 6 with the attachment region 2 of the magazine 1, the grooves 4 and a U-shaped spring 8 are used. The U-shaped spring 8, which is preloaded in a plane extending transverse to the setting direction, is formed as a clamp that projects beyond the inner profile 10 of the connection region 9 and formlocklingly engages in the grooves 4.

To prevent rotation of the washer holder 6 relative to the attachment region 2, the outer profile of the attachment region 2 of the magazine 1, which lies in the plane extending transverse to the setting direction, and the inner profile 10 of the connection region 9 of the washer holder 6 deviate from a circular profile.

As shown in FIGS. 3–4, the connection region 9 of the washer holder 6, at its side facing in a direction toward the free end of the magazine 1, is partially open. This insured that the washer holder 6 can slide on the attachment region 2 in the direction toward the free end of the magazine 1. The sliding-on of the washer holder 6 on the, attachment region 2 is facilitated by a run-on bevel 12 which faces in a direction opposite the setting direction and which extends from the circumferences of the washer holder 6 to the open region of the connection region 9 of the washer holder 6. The run-on bevel 12 of the washer holder 6 is adjoined, at its side facing in a direction toward the central axis of the washer holder 6 by a stop edge 13 of the connection region 9.

In order to be able to formlockingly connect the washer holder 6, which is displaceable on the attachment region 2, with the attachment region 2, it is necessary to so displace the washer holder 6 in the direction opposite the setting direction until the attachment region 2 of the magazine 1 abuts the bottom 17 of the connection region 9 of the washer holder 6. The U-shaped spring 8 should project into the grooves 4 of the attachment region 2 of the magazine 1, and the stop edge 13 should sidewise adjoin the attachment region 2. In this position of the washer holder 6, its displacement transverse to the setting direction is not any more possible. The stop edge 13 forms part of the inner profile 10 of the washer holder 6.

Upon application of a force acting in the setting direction, the washer holder can be pulled-off the attachment region 2 of the magazine 1. In this case, the regions of the U-shaped spring 8, which cooperate with the grooves 4, would be pressed out sidewise of the grooves 4.

The washer holder 6 has an intermediate wall that forms, at the setting direction side of the washer holder 6, the stop surface 7 for a washer and forms, at the side of the washer holder 6 facing in the direction opposite the setting direction, the bottom 17 of the connection region 9 of the washer holder 6. A bore 11 is formed in the intermediate wall. The bore 11 extends in the radial direction in the open side region of the connection region 9. The width of the open side region of the connection region 9 is greater than a diameter of a piston rod of the drive piston 5 that is axially displaceable in a guide cylinder (not shown) of the setting tool and is shown only partially.

Though the present invention was shown and described with references to the preferred embodiment, such is merely illustrative of the present invention and is not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A magazine with bolt-shaped fastening elements for a setting tool and extending sidewise of a bolt guide (3) of the setting tool which is displaceable in the setting tool housing parallel to a setting direction of a fastening element, the magazine (1) compromising an attachment region (2) provided at an end region of the magazine (1) facing in the setting direction; and a washer holder (6) releasably attachable to the attachment region (2) of the magazine (1) and having a central axis that extends substantially coaxially with a central axis of a receiving bore of the bolt guide (3), wherein the washer holder (6) has a connection region (9) connectable with the attachment region (2) of the magazine, wherein the connection region (9) of the washer holder (6) comprises means for formlockingly connecting the connection region (9) with the attachment region (2) of the magazine (1), and wherein the formlockingly connecting means comprises a projection provided in the connection region (9) of the washer holder (6) and cooperating with an opening formed in an outer profile of the attachment region (2) of the magazine (1).

2. A magazine according to claim 1, wherein the opening is formed as a groove (4) extending transverse to the setting direction.

3. A magazine according to claim 1, wherein the projection extends beyond an inner profile (10) of the connection region (9), cooperates with the attachment region (2), and is formed by a spring (8) preloaded in a direction transverse to the setting direction.

4. A magazine according to claim 1, wherein the attachment region (2) has an outer profile which extends transverse to the setting direction and which, together with an inner profile (10) of the connection region (9), deviate from a circular shape.

5. A magazine according to claim 1, wherein the washer holder (6) comprises a receiving region (14) provided at a setting direction side thereof and having a stop surface (7) facing in the setting direction, and a circumferential annular web (15) that surrounds the stop surface (7) and projects therepast in the setting direction, the annular web (15) being resiliently expandable at least in a radial direction.

6. A magazine according to claim 5, wherein at least the receiving region (14) of the washer holder (6) is formed of an elastic material.

7. A magazine according to claim 5, further comprising magnetic retaining means (16) provided in the receiving region (14) of the washer holder (6).

* * * * *